United States Patent [19]

Webb

[11] 4,109,620

[45] Aug. 29, 1978

[54] CARBURETION MODIFYING DEVICE

[76] Inventor: George M. Webb, Ames, Iowa

[21] Appl. No.: 788,262

[22] Filed: Apr. 18, 1977

[51] Int. Cl.[2] ..... F02B 29/04

[52] U.S. Cl. ..... 123/52 M; 48/180 M; 123/141

[58] Field of Search ..... 123/52 M, 52 MC, 52 MV, 123/141; 48/180 R, 180 M

[56] References Cited

U.S. PATENT DOCUMENTS

| | | | |
|---|---|---|---|
| 3,393,984 | 7/1968 | Wisman | 123/141 |
| 3,811,416 | 5/1974 | Gospodar et al. | 123/52 M |
| 3,814,391 | 6/1974 | Cedarholm | 48/180 R |
| 3,968,780 | 7/1976 | Konomi et al. | 123/141 |

*Primary Examiner*—Charles J. Myhre
*Assistant Examiner*—Craig R. Feinberg
*Attorney, Agent, or Firm*—Zarley, McKee, Thomte, Voorhees & Sease

[57] ABSTRACT

A carburetion modifying device for mounting within the throat of the intake passageway of a conventional intake manifold is disclosed. The modifying device comprises a cylindrical sleeve, an annular lip at the top of the sleeve to engage the top of the intake manifold between the intake manifold and a conventional carburetor, and an eliptical shaped deflector partition to deflect the gas-air mixture from the carburetor to the intake manifold.

9 Claims, 3 Drawing Figures

CARBURETION MODIFYING DEVICE

BACKGROUND OF THE INVENTION

The present invention relates generally to a multi-cylinder internal combustion engine and more particularly to a carburetion modifying device for equal distribution of the fuel-air mixtures to the cylinders of a multi-cylinder engine.

Various methods for distributing the fuel-air mixture between the cylinders of a multi-cylinder engine to improve gas mileage have been devised and demonstrated, but have suffered from a corresponding increase in the amount of lubricating oil being burned by the engine. Prior carburetion modifying devices have not been effective and useful because of this increased burning of lubricating oil.

SUMMARY OF THE INVENTION

A carburetion modifying device is disclosed wherein a cylindrical sleeve having an eliptical deflecting partition mounted within the sleeve and protruding through a notch in the sleeve wall is mounted within the intake throat of a conventional intake manifold between the carburetor and intake manifold. An annular lip at the top edge of the sleeve engages the top of the manifold and holds the sleeve in position in the manifold throat. The eliptical partition deflects the fuel-air mixture as it is drawn from the carburetor to the intake manifold so as to increase gas mileage without causing the engine to burn an increased amount of lubricating oil.

It is a principal object of this invention to provide a carburetion modifying device to increase gas mileage in an internal combustion engine.

A further object of this invention is to provide a carburetion modifying device that does not increase the amount of lubricating oil being burned during operation of an internal combustion engine.

A still further object of this invention is to provide a carburetion modifying device that is easily and quickly mounted within a standard intake manifold just below the carburetor.

A still further object is to provide a carburetion modifying device that is economical to manufacture and durable in use.

DESCRIPTION OF THE PREFERRED EMBODIMENT

The numeral 10 refers to the carburetion modifying device of this invention.

Figure 1:
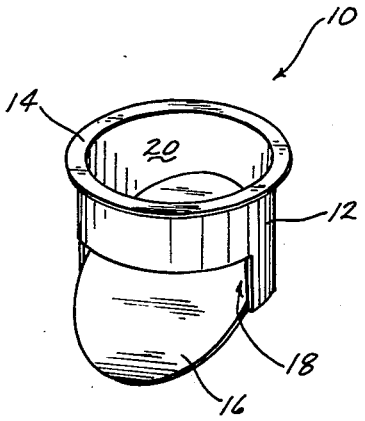
FIG. 1 is a perspective view of the invention.
Figure 3:
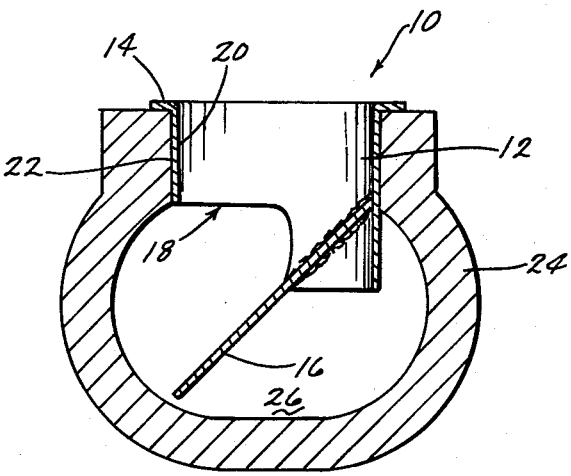
FIG. 3 is a sectional view seen along line 3—3 of FIG. 2.

Modifier 10 is generally comprised of cylindrical sleeve 12 having annular lip 14 secured to the top edge and notch 18 at the bottom edge as shown in FIGS. 1 and 3. The partition 16 is eliptical in shape and securely mounted to the inside surface 20 of sleeve 12 and protrudes out notch 18.

Figure 2:
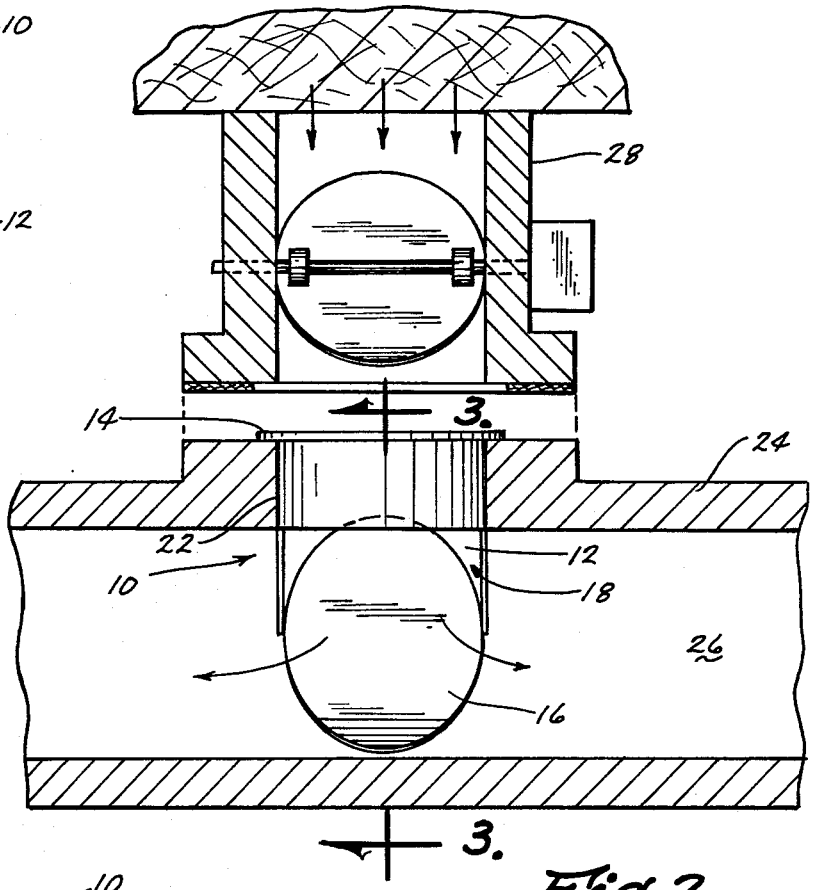
FIG. 2 is a sectional view of the invention mounted to a conventional intake manifold and carburetor.

Modifier 10 is mounted in throat 22 of an intake manifold 24 with a conventional carburetor 28 mounted above it as shown In FIG. 2. The orientation of the modifier with respect to the intake manifold is critical. The modifier 10 is mounted in throat 22 so the minor axis of eliptical partition 16 coincides with the diameter of sleeve 12 parallel to the direction of the mixture flow in manifold passageway 26 as shown in FIGS. 2 and 3. The major axis of eliptical partition 16 terminates near the bottom of manifold passageway 26 as shown in FIG. 3 and makes a 45° angle with the longitudinal axis of sleeve 12. Modifier 10 is securely mounted in throat 22 to prevent rotation or flutter of partition 16. Any deviation from the above described orientation detracts from the efficiency of modifier 10.

Modifier 10 is quickly and easily mounted to a conventional intake manifold as follows: Carburetor 28 is removed from intake manifold 24. Modifier 10 is inserted in throat 22 in accordance with the above description and securely attached to manifold 24. Carburetor 28 is then remounted to manifold 24.

In operation, the partition 16 deflects a fuel-air mixture from the carburetor as indicated by the arrows in FIG. 3 so as to increase gas mileage without causing excessive burning of oil.

Thus, it can be seen that the invention accomplishes at least all of its stated objectives.

What is claimed is:

1. In combination with an internal combustion engine having a plurality of cylinders, an intake manifold, and a carburetor, said intake manifold having an intake throat in communication with said carburetor, said manifold having a fuel-air passageway with upper and lower wall portions connecting said throat and said cylinders, the invention comprising, a cylindrical sleeve having top and bottom portions mounted within said throat, and an eliptical-shaped deflecting partition securely mounted within said sleeve at said bottom portion to deflect the fuel-air mixture from said intake throat into said fuel-air passageway, said partition terminating near said lower wall portion.

2. The combination of claim 1 wherein said cylindrical sleeve has a notch in said bottom portion and said deflecting partition protrudes through said notch.

3. The combination of claim 1 wherein means are provided in said engine to rigidly mount said sleeve within said throat so as to prevent any rotation or flutter of said partition.

4. The combination of claim 1 wherein an annular lip is rigidly attached to said top portion of said sleeve so as to be positioned between said manifold and said carburetor.

5. The combination of claim 1 wherein said eliptical shaped deflecting partition has a major and a minor axis with said minor axis coinciding with the diameter of said cylindrical sleeve and parallel to the direction of fuel-air mixture flow in said fuel-air passageway.

6. The combination of claim 5 wherein said major axis is at a 45° angle with the longitudinal axis of said cylindrical sleeve.

7. In combination with an internal combustion engine having a plurality of cylinders, an intake manifold, and a carburetor, said intake manifold having an intake throat in communication with said carburetor and a fuel-air passageway connecting said throat and said cylinder with the longitudinal axis of said fuel-air passageway being approximately perpendicular to the longitudinal axis of said intake throat, said fuel-air passageway having upper and lower wall portions the invention comprising, a cylindrical sleeve mounted within said throat, said sleeve having top and bottom portions, and an eliptical-shaped deflecting partition securely mounted within said sleeve at said bottom portion to deflect the fuel-air mixture from said intake throat into said fuel-air passageway, said eliptical-shaped deflecting partition having a major and a minor axis and positioned within said sleeve so that said minor axis is approximately parallel to the longitudinal axis of said fuel-air passageway, said major axis terminating near said lower wall portion of said fuel-air passageway.

8. The combination of claim 7 wherein said major axis is at approximately a 45° angle with said longitudinal axis of said throat, said major axis terminating near said lower portion of said fuel-air passageway.

9. In combination with an internal combustion engine having a plurality of cylinders, an intake manifold and a carburetor, said intake manifold having an intake throat in communication with said carburetor, said intake manifold having a fuel-air passageway connecting said throat and said cylinders, said passageway having upper and lower wall portions, the invention comprising, a sleeve member adapted to be received and securely mounted within said throat, said sleeve having top and bottom portions, and an eliptical-shaped deflecting partition securely mounted within said sleeve at said bottom portion to deflect the fuel-air mixture from said intake throat into said fuel air passageway, said eliptical deflecting partition having a major and minor axis with said sleeve mounted within said throat so that said minor axis is approximately parallel to the direction of flow of fuel-air mixture in said passageway to said cylinders.

* * * * *